US008130593B2

(12) United States Patent
Hayashi et al.

(10) Patent No.: US 8,130,593 B2
(45) Date of Patent: Mar. 6, 2012

(54) PRESSURE WAVE GENERATOR AND TEMPERATURE CONTROLLING METHOD THEREOF

(75) Inventors: Masato Hayashi, Amagasaki (JP); Masami Yakabe, Tokyo (JP); Nobuyoshi Koshida, Tokyo (JP)

(73) Assignees: Tokyo Electron Limited, Tokyo (JP); National University Corporation, Tokyo University of Agriculture and Technology, Tokyo (JP)

( * ) Notice: Subject to any disclaimer, the term of this patent is extended or adjusted under 35 U.S.C. 154(b) by 353 days.

(21) Appl. No.: 12/521,120

(22) PCT Filed: Dec. 17, 2007

(86) PCT No.: PCT/JP2007/074248

§ 371 (c)(1),
(2), (4) Date: Jun. 24, 2009

(87) PCT Pub. No.: WO2008/081706

PCT Pub. Date: Jul. 10, 2008

(65) Prior Publication Data

US 2010/0025145 A1 Feb. 4, 2010

(30) Foreign Application Priority Data

Dec. 28, 2006 (JP) ..... 2006-355625

(51) Int. Cl.
*B06B 1/06* (2006.01)
*G10K 15/04* (2006.01)

(52) U.S. Cl. ..... 367/140; 181/142

(58) Field of Classification Search ..... 367/902; 181/142

See application file for complete search history.

(56) References Cited

U.S. PATENT DOCUMENTS

| | | | | |
|---|---|---|---|---|
| 4,258,569 | A * | 3/1981 | Buchy et al. | 219/494 |
| 2003/0124764 | A1 * | 7/2003 | Yamazaki et al. | 438/99 |
| 2005/0201575 | A1 * | 9/2005 | Koshida et al. | 381/164 |
| 2007/0217289 | A1 * | 9/2007 | Watabe et al. | 367/189 |
| 2007/0230721 | A1 * | 10/2007 | White et al. | 381/166 |

FOREIGN PATENT DOCUMENTS

| | | |
|---|---|---|
| JP | 11-300274 | 11/1999 |
| JP | 2003-154312 | 5/2003 |
| JP | 2005-73197 | 3/2005 |
| JP | 2005-269745 | 9/2005 |
| JP | 2005-313086 | 11/2005 |
| JP | 2006-013961 | 1/2006 |
| JP | 2007-144406 | 6/2007 |

OTHER PUBLICATIONS

Taiwanese Office Action for corresponding TW Application No. 096150357, Mar. 1, 2011.

* cited by examiner

*Primary Examiner* — Thomas Tarcza
*Assistant Examiner* — James Hulka
(74) *Attorney, Agent, or Firm* — Ditthavong Mori & Steiner, P.C.

(57) ABSTRACT

A pressure wave generator (1) includes a thermally conductive substrate (2), a heat insulating layer (3) formed on one main surface of the substrate (2), an insulator layer (5) formed on the heat insulating layer (3), and a heat generator (4) formed on the insulator layer (5) to generate heat when a current containing an alternating component is applied thereto. The heat insulating layer (3) is formed containing at least one of silicon nitride ($Si_3N_4$), silicon dioxide ($SiO_2$), aluminum oxide ($Al_2O_3$), magnesium oxide (MgO), diamond crystalline carbon (C), aluminum nitride (AlN), and silicon carbide (SiC). The heat generator (4) is formed containing, for example, gold (Au) or tungsten (W).

13 Claims, 5 Drawing Sheets

(a)

(b)

PRESSURE WAVE GENERATOR AND TEMPERATURE CONTROLLING METHOD THEREOF

TECHNICAL FIELD

The present invention relates to a pressure wave generator that generates a pressure wave (compression wave) by applying heat to a gas and a temperature controlling method using such a generator.

BACKGROUND ART

Conventionally, a device has been proposed in which by applying heat to air periodically, compressed portions of the air are formed, so that a pressure wave (compression wave, that is, an acoustic wave or an ultrasonic wave) is consequently generated (for example, see Patent Documents 1 to 4). In the device disclosed in Patent Document 1, a metal thin film serving as a heating element is formed on a substrate. By allowing a current to flow through this metal thin film, heat is generated therein and the heat is conducted to an air layer that is made in contact with the surface of the metal thin film. Moreover, in this device, a porous layer, a polymer layer or the like that has an extremely small thermal conductivity is formed between the heating element and the substrate. This porous layer or polymer layer is allowed to form a heat insulating layer and thermally insulates the heating element from the substrate. By this heat insulating layer, the flow of heat from the metal thin film to the substrate is suppressed to a low level so that the ratio of a temperature change occurring in the metal thin film relative to power of a signal that drives the metal thin film is made greater. As a result, pressure wave energy to be transmitted to the air layer made in contact with the surface of the metal thin film becomes greater, thereby making it possible to improve the generation efficiency of acoustic wave.

Moreover, Patent Document 2 has disclosed a technology in which, by changing an electric current flowing through the heating element into a periodic or non-periodic pulse state or a burst wave state that has power concentrated within a short period of time, the time-averaged power of a generated sound relative to the time-averaged applied power is improved.

Patent Document 3 has disclosed a technology in which, by forming a large number of pores are formed on a nanocrystalline silicon of the insulating layer, the degree of its porosity is set to 75% or more so that a sound pressure level is enhanced. Moreover, Patent Document 4 has disclosed a technology in which, by setting the thickness of a nanocrystalline silicon layer of the heat insulating layer to a level that is not less than a heat diffusion length specified by a frequency of an ultrasonic wave to be oscillated and is not more than a thickness obtained by adding 5 μm to the heat diffusion length, the power resistant characteristic is improved and the maximum generated sound pressure is consequently increased.

Patent Document 1: Japanese Patent Application Publication No. 11-300274

Patent Document 2: Japanese Patent Application Publication No. 2003-154312

Patent Document 3: Japanese Patent Application Publication No. 2005-73197

Patent Document 4: Japanese Patent Application Publication No. 2005-269745

Problems to be Solved by the Invention

However, in the above-mentioned device that generates an acoustic wave by applying heat to air using a heating element (conductor) that generates heat by power, a metal thin film (conductor layer) forming the heating element tends to be deformed or raised in the air depending on places. Moreover, when such a metal thin film is locally heated, an excessive stress is sometimes caused in the film, or the metal thin film sometimes has a local portion having a temperature exceeding the melting point of the metal. When the applied voltage is increased so as to increase the sound pressure of an acoustic wave to be generated, the metal thin film causes a disconnection in a short time. Therefore, in order to avoid the disconnection of the heating element, the current to be applied is limited. As a result, constantly, only a small sound pressure has been obtained.

In view of this state of the art, the object of the present invention is to provide a pressure wave generator in which a conductor serving as a heating element is hardly disconnected and the maximum generated sound pressure can be made greater, and a method for temperature-controlling such a generator.

Means for Solving the Problem

In order to achieve the above-mentioned objective, a pressure wave generator (1) in accordance with a first aspect of the present invention is provided with: a thermally conductive substrate (2); a heat insulating layer (3) formed on one main surface of the substrate; an insulator layer (5) formed on the heat insulating layer; and a conductor layer (4), formed on the insulator layer, that generates heat when a current containing an alternating component is applied thereto.

A method for controlling a temperature of a pressure wave generator in accordance with a second aspect of the present invention is provided with the steps of: preparing a thermally conductive substrate (2); a heat insulating layer (3) formed on one main surface of the substrate; and a conductor layer (4), formed on the insulator layer, that generates heat when a current containing an alternating component is applied thereto; and in this method, by forming an insulator layer (5) on the heat insulating layer, the temperature of the conductor layer is controlled.

DESCRIPTION OF REFERENCE SYMBOLS

1 Pressure wave generator

2 Substrate

3 Heat insulating layer
4 Heating element (conductor layer)
5 Insulator layer
6 Driving circuit
7 Electrode layer

DESCRIPTION OF THE PREFERRED EMBODIMENTS

Figure 1:
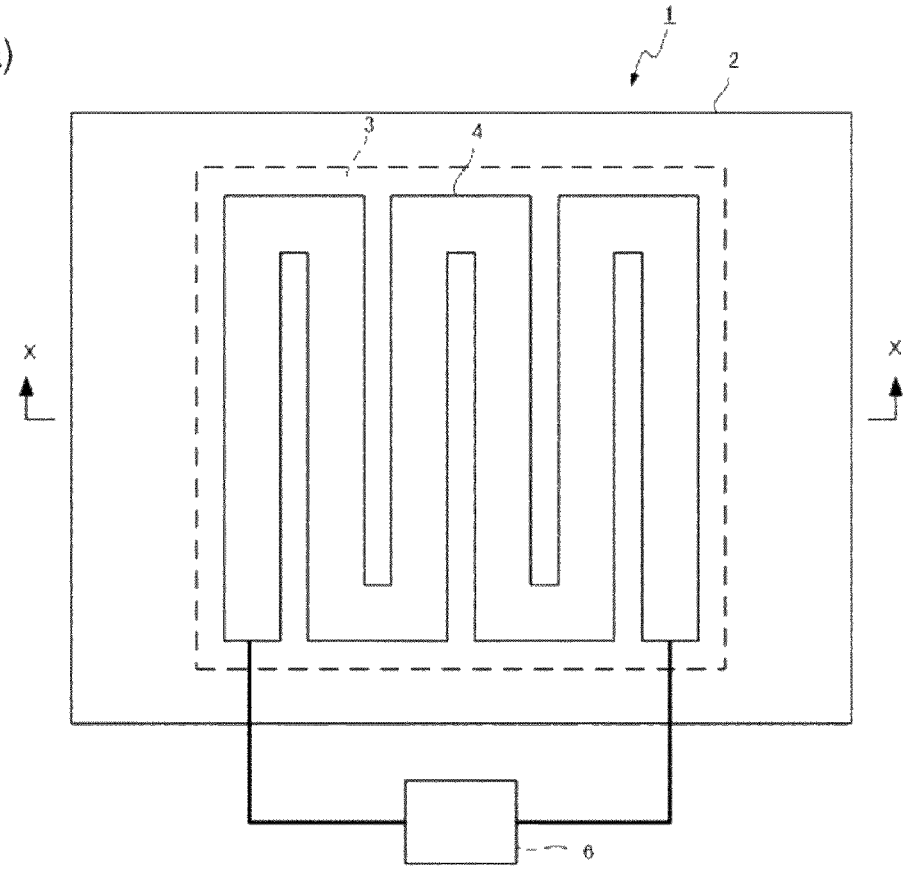
FIG. 1(*a*) is a plan view that shows a structure of a pressure wave generator in accordance with one embodiment of the present embodiment, and FIG. 1(*b*) is a cross-sectional view that shows the structure of the pressure wave generator of FIG. 1(*a*).
Figure 1:
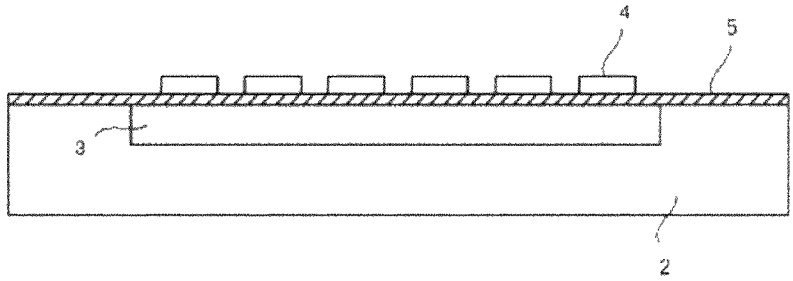

Referring to Figs., the following description will discuss embodiments of the present invention in detail. Here, in Figs., those portions that are the same or corresponding portions are indicated by the same reference numeral, and the explanation thereof will not be repeated. FIGS. 1(*a*) and 1(*b*) show a structure of a pressure wave generator in accordance with one embodiment of the present invention. FIG. 1(*a*) is a plan view showing the pressure wave generator to which a driving circuit, which will be described later, is connected, and FIG. 1(*b*) shows an X-X line cross-sectional view of FIG. 1(*a*).

A pressure wave generator 1 of the present embodiment is a device for generating a pressure wave (acoustic wave) upward in the drawing face of FIG. 1 (*a*). As shown in FIG. 1, the pressure wave generator 1 is provided with a substrate 2, a heat insulating layer 3, a heating element 4 and an insulator layer 5. The substrate 2 is made from bulk silicon and the like. The heat insulating layer 3 is formed on one of main surfaces (main surface on the upper side of the drawing face) of the substrate 2. The heat insulating layer 3 is composed of a nanocrystalline silicon (hereinafter, referred to as nc-Si) that is a porous material. The insulator layer 5 is formed on the heat insulating layer 3 so as to be made in contact therewith. The insulator layer 5 is a thin film of an insulator, for example, such as silicon nitride ($Si_3N_4$), silicon dioxide ($SiO_2$) and aluminum oxide ($Al_2O_3$). The heating element 4 is formed on the insulator layer 5 in contact therewith. The heating element 4 is a thin film made of a conductive metal, for example, such as gold (Au) and tungsten (W). The heating element 4 is formed into a winding shape with a predetermined interval. A driving circuit 6 is electrically connected to the both ends of the heating element 4.

The driving circuit 6 applies a pulse voltage or an AC voltage that is intermittently driven with a predetermined frequency $\omega$ to the both ends of the heating element 4. The amount of heat generation by the heating element 4 fluctuates with fluctuations of the applied voltage. Here, the fluctuating component of heat generation of the fluctuating heating element 4 is referred to as "AC component of heat generation." Moreover, a DC component corresponding to a simple increasing component of the heat generation that does not devote to the generation of a pressure wave is also generated in the heating element 4 in response to its heat capacity. This is hereinafter referred to as "DC component of heat generation." In the present embodiment, the thickness of the heat insulating layer 3 is set to the same level as a thermal diffusion length of the heat insulating layer 3 that is determined by the heat conductivity and the heat capacity per unit volume thereof relative to the AC component of heat generation. With this arrangement, the AC component of heat generation can be heat-insulated from the substrate 2 side by the heat insulating layer 3, so that the DC component of heat generation caused by the heat capacity of the heating element 4 is effectively released to the substrate 2 having a larger heat conductivity. In the case when the material of the heat insulating layer 3 is nc-Si, the thickness of the heat insulating layer 3 may be, for example, set to approximately 5 μm to 200 μm. The thickness of the heat insulating layer 3 may be altered on demand in accordance with the frequency band of an acoustic wave to be generated.

The thickness of the insulator layer 5 is made sufficiently thinner than the thermal diffusion length. Therefore, the AC component of heat generation of the heating element 4 is heat-insulated in the thickness direction mainly by the heat insulating layer 3. The insulator layer 5 conducts heat in the face direction. Here, the heating element 4 is made in tightly contact with the insulator layer 5. Therefore, the insulator layer 5 functions in a manner so as to make the temperature distribution of the heating element 4 uniform.

In a conventional structure without the insulator layer 5, the heat generator body 4 is directly made in contact with the heat insulating layer 3. Since the heat insulating layer 3 is made from porous nc-Si, there are some portions in which the heating element 4 is made in contact with nc-Si crystal grains and other portions in which it is not made in contact therewith, from a microscopic point of view. There is a difference in the manner of temperature rise between those portions made in contact with the crystal grains and those portions that are not made in contact therewith. In general, in those portions made in contact with nc-Si crystal grains, the temperature rise is slow, while the temperature rise is quick, in those portions that are not made in contact with nc-Si crystal grains. As a result, irregularities occur in the temperature distribution of the heating element 4, with the result that the heating element 4 might be deformed, or separated, or in some cases, might have a disconnection.

In the pressure wave generator 1 of the present embodiment, since the insulator layer 5 does not conduct electricity, it does not generate heat and functions so as to make the temperature distribution of the heating element 4 uniform. Thus, a local thermal stress in the heating element 4 is alleviated. Therefore, even in the case when such a voltage as to cause disconnection in a conventional pressure wave generator is applied to the heating element 4, the deformation and disconnection of the heating element 4 hardly occur. As a result, it becomes possible to increase a sound pressure of an acoustic wave to be generated by the pressure wave generator 1.

With respect to the insulator layer 5, it is necessary to provide such a layer that has a high thermal conductivity in the in-plane direction and does not absorb heat in the thickness direction. Therefore, the insulator layer 5 is preferably made from a material that has a high thermal conductivity with a low specific heat capacity, and formed into a thin layer. In addition to the aforementioned silicon nitride ($Si_3N_4$), silicon dioxide ($SiO_2$) and aluminum oxide ($Al_2O_3$), examples of the material for the insulator layer 5 also include, for example, magnesium oxide (MgO), diamond crystal carbon (C), aluminum nitride (AlN) or silicon carbide (SiC). The thickness of the insulator layer 5 is, for example, set to approximately 50 nm to 200 nm.

The material for the heating element 4 is not particularly limited, as long as it is prepared as a metal film. Examples thereof include metal simple substances, such as tungsten (W), molybdenum (Mo), iridium (Ir), gold (Au), aluminum (Al), nickel (Ni), titanium (Ti) and platinum (Pt), and a laminated structure of these may also be used as the heating element 4. The heating element 4 may be film-formed by using a vacuum vapor deposition method, a sputtering method or the like. Here, the film thickness of the heating element 4 is preferably made as thin as possible so as to make the heat capacity smaller. The film thickness thereof is preferably selected from a range from 10 nm to 300 nm so as to provide an appropriate resistance value.

Figure 2A:
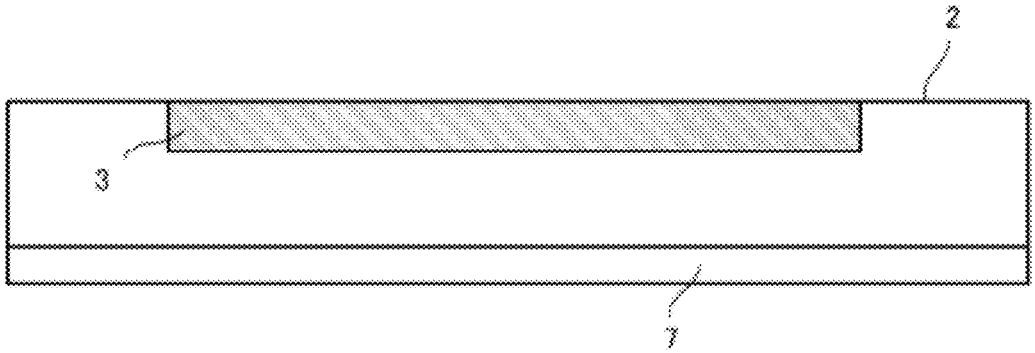
FIG. 2A is a drawing that explains manufacturing processes of the pressure wave generator of FIG. 1A.
Figure 2B:
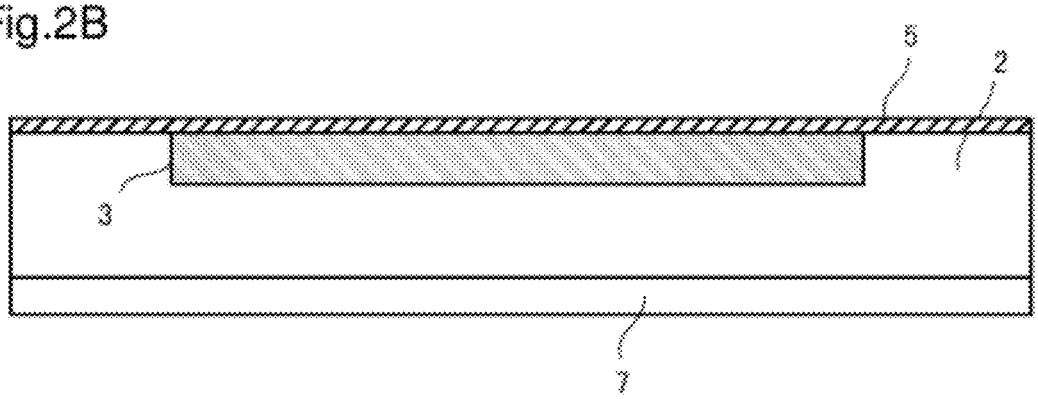
FIG. 2B is a cross-sectional view that shows a substrate in which an insulator layer is formed on a heat insulating layer.
Figure 2C:
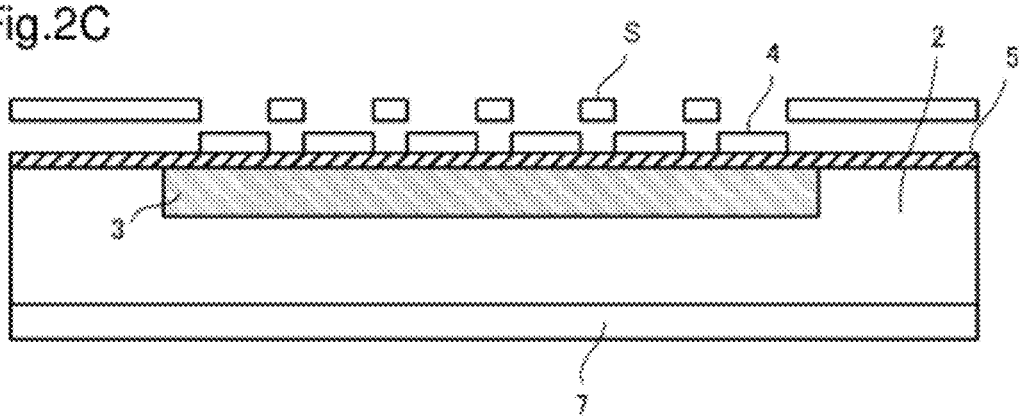
FIG. 2C is a cross-sectional view that shows a substrate in which a heating element is formed on the insulator layer.

Next, the following description will discuss processes by which the pressure wave generator 1 is formed. FIGS. 2A to 2C show one example of the manufacturing process of the pressure wave generator 1. First, as shown in FIG. 2A, a silicon wafer substrate 2 is prepared. Moreover, an electrode layer 7, formed by, for example, an aluminum thin film, is formed on the rear surface thereof by using a vacuum vapor deposition method, or the like. By using a mixed solution of hydrofluoric acid (HF) and ethanol, a portion to be formed into a heat insulating layer 3 is subjected to an anodic treatment by using platinum (Pt) as a counter electrode. The component ratio, current density and treating time of the solution are controlled to predetermined values, so that a nc-Si heat insulating layer 3, formed into a desired thickness and a porous structure with a desired grain size, is formed (see FIG. 2A).

FIG. 2B is a cross-sectional view showing a substrate 2 composed of an insulator layer 5 formed on the heat insulating layer 3. As shown in FIG. 2B, the insulator layer 5 is formed on the face of the substrate 2 on which the heat insulating layer 3 is formed. The insulator layer 5 is formed, for example, by depositing non-dope silicate glass (NSG) or the like on the substrate 2 by using a plasma CVD process.

FIG. 2C is a cross-sectional view showing the substrate 2 in which a heating element 4 is formed on the insulator layer 5. As shown in FIG. 2C, for example, a stencil mask S, patterned into a shape of the heating element 4, is held on the insulator layer 5, and the heating element 4 is formed on the insulator layer 5 with a predetermined pattern by a sputtering process of gold (Au).

Thereafter, an electrode or the like used for connecting a driving circuit 6 to the heating element 4 is formed, and after a removing process of the electrode layer 7, if necessary, a polishing process and the like have been carried out on the rear face (not shown), a pressure wave generator 1 is completed. As described above, the pressure wave generator 1 can be formed by using manufacturing processes for an nc-Si layer and a general semiconductor device.

EXAMPLES

Referring to FIGS. 3 to 6, the following description will discuss specific examples of a pressure wave generator in accordance with the present invention in detail. In the following description, the pressure wave generator 1 of the above-mentioned embodiment and a conventional pressure wave generator will be explained in comparison with each other on demand. In each of the pressure wave generators, a p-type Si wafer having a substrate resistivity of 5 Ω·cm was used as the substrate 2, and the thickness of the nc-Si heat insulating layer 3 was set to 100 μm. In the conventional pressure wave generator, a heating element 4 made of aluminum was formed on the heat insulating layer 3. In contrast, in the pressure wave generator 1 of the present example, non-dope silicate glass (NSG) having a thickness of 200 nm was formed on the heat insulating layer 3 as the insulator layer 5 by plasma CVD, and a heating element 4 was formed thereon by using aluminum in the same manner as in the prior art. Here, in each of the pressure wave generators 1, by applying a pulse voltage that was intermittently driven by the driving device 6 to the heating element, an acoustic wave was generated.

Figure 3:
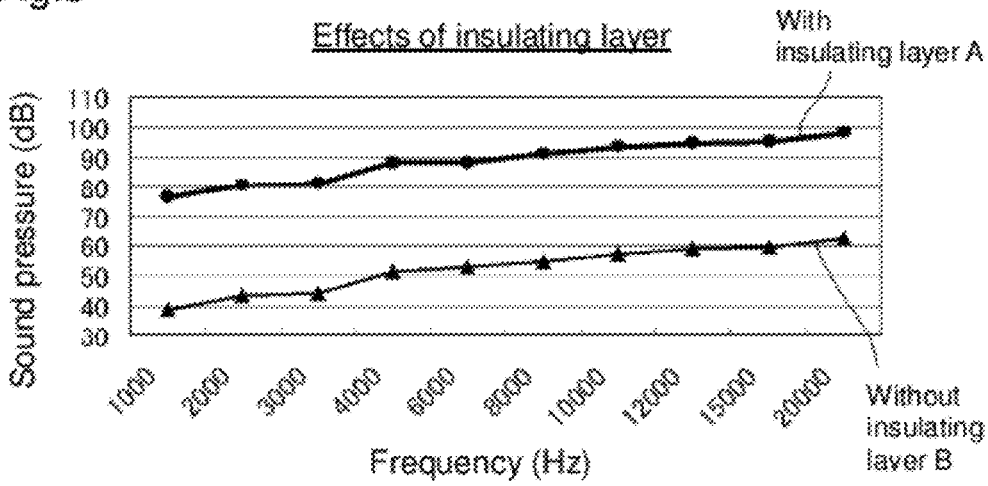
FIG. 3 is a graph that shows effects of the insulator layer.

FIG. 3 shows sound pressure levels relative to frequencies of inputted power with respect to the respective devices. In the graph of FIG. 3, the axis of abscissas represents the frequency (Hz) of an inputted power, and the axis of ordinates represents the sound pressure (dB).

In FIG. 3, the frequency characteristic of a sound pressure of the pressure wave generator 1 having the insulator layer 5 of A is represented by black dots and a thick solid line. Moreover, the frequency characteristic of a sound pressure of the conventional pressure wave generator 1 without the insulator layer 5 of B is represented by triangles and a thin solid line B.

Here, in the conventional pressure wave generator without the insulator layer 5, in the case of an inputted power of 1 W, the heating element 4 caused a disconnection. In contrast, in the pressure wave generator 1 of the present invention, even when the inputted power was raised to 100 W, no disconnection occurred in the heating element 4.

Therefore, in the case of the thick solid line A "with the insulator layer", the power to be inputted to the heating element 4 was set to 100 W, and in the case of the thin solid line B "without the insulator layer", the power to be inputted to the heating element 4 was set to 1 W. In the case of "without the insulator layer", it was not possible to input power exceeding 1 W since the heating element 4 caused a disconnection.

As shown in FIG. 3, the difference in the maximum outputable sound pressure between the case "with the insulator layer" and the case "without the insulator layer" is 35 dB or more over a range from 1 kHz to 20 kHz. In order to continuously operate these pressure wave generators, each of the devices needs to be derated, and with respect to the difference in the maximum sound pressure in the case of the continuous operations also, it is considered to be 35 dB or more.

Moreover, the pressure wave generator 1 in accordance with the present embodiment has an effect in that no irregularities occur in the directional characteristics of acoustic wave, with uniformed wave faces being obtained.

Figure 4:
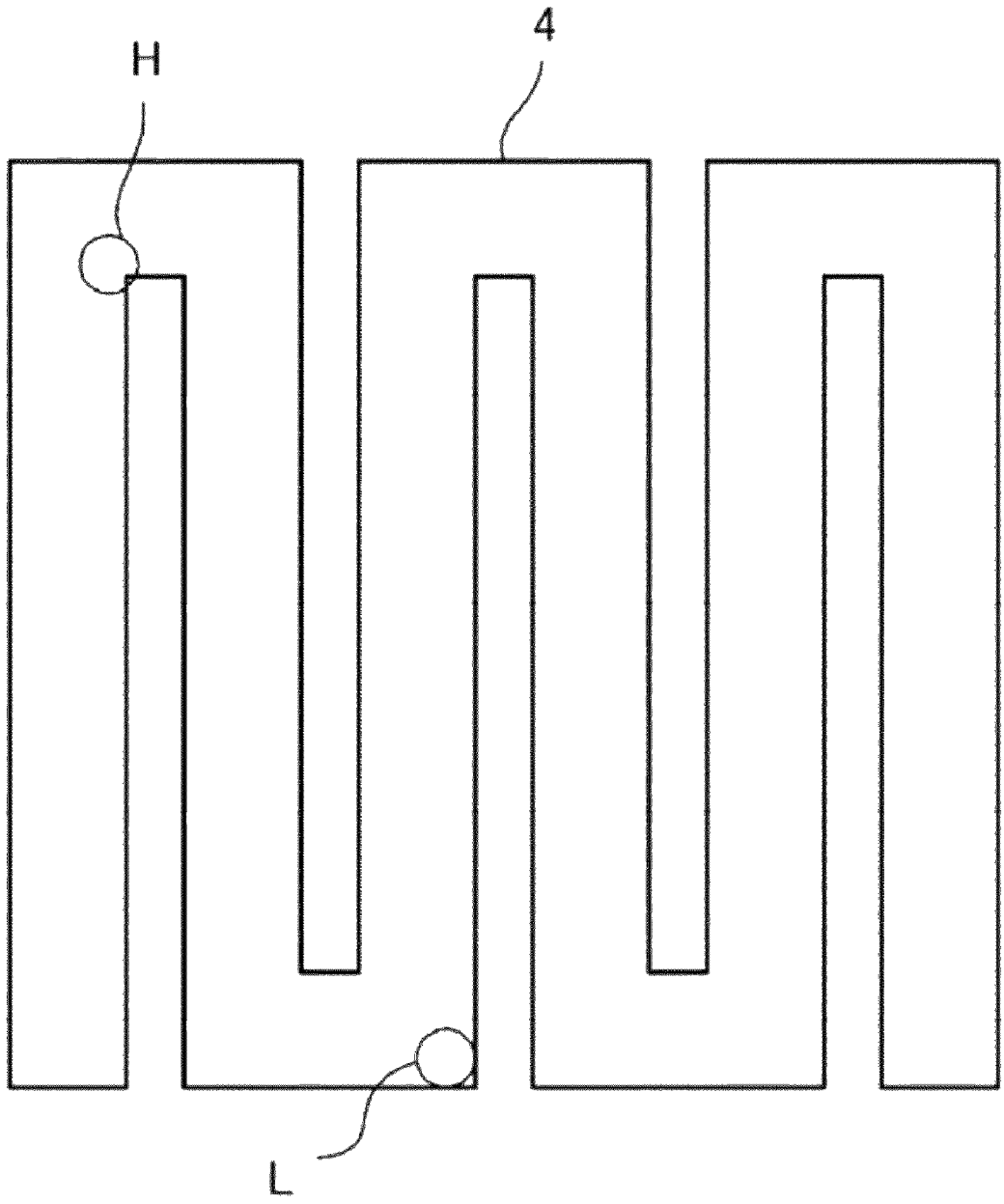
FIG. 4 is a drawing that explains the fact that the quantity of heat generation differs depending on portions of the heating element.

FIG. 4 is a top face view of the heating element 4. As shown in FIG. 4, in the case where no insulator layer 5 is installed, the amount of heat generation becomes greater at a corner portion H inside a bent portion of the heating element 4, while the amount of heat generation becomes smaller at a corner portion L outside the bent portion. In the case where the amount of heat generation defers depending on positions of the heating element 4, the amplitude of a compression wave generated from the portion having a large amount of heat generation becomes greater than the amplitude of the compression wave generated from the portion having a small quantity of heat generation. For this reason, a phenomenon that is similar to the phenomenon in which acoustic waves are generated around a portion having a large amount of heat generation generates.

Figure 5:
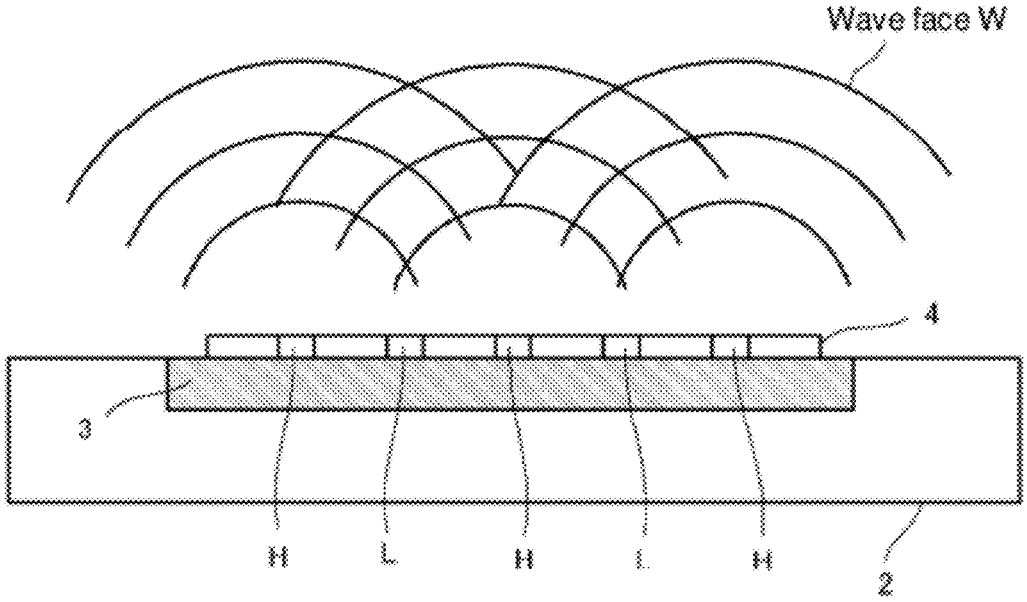
FIG. 5 is a drawing that schematically shows a state in which acoustic waves spread in the case when no insulator layer is formed.

As a result, acoustic waves, generated from respective portions having large amounts of heat generation in the heating element 4, interfere with one another, resulting in strong/week portions of an acoustic wave that is a kind of interference stripes. Consequently, depending on places (depending on differences in distance and azimuth from the pressure wave generator 1), irregularities occur in the sound pressure of an acoustic wave generated by the pressure wave generator 1. FIG. 5 is a drawing that schematically shows a state in which an acoustic wave spreads depending on the difference in the amount of heat generation. As shown in FIG. 5, in the case of such a device as to cause strong/week portions, such as spreads and interference stripes, in its generated acoustic wave, it is inconvenient to be applied as, for example, a sound source for an ultrasonic wave sensing process.

In contrast, in the pressure wave generator 1 of the present example, since the temperature distribution of the heating element (conductor layer) 4 is made uniform by the insulator layer 5, acoustic waves are generated from the entire heating element (conductor layer) 4 with virtually the same intensity.

Figure 6:
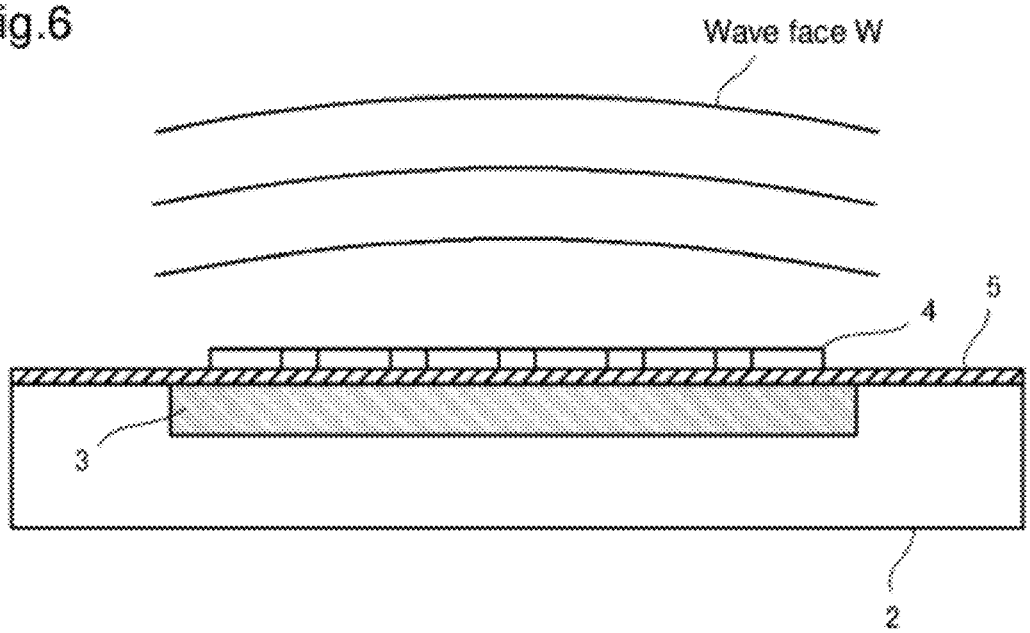
FIG. 6 is a drawing that schematically shows a state in which acoustic waves propagate in the case when an insulator layer is formed.

FIG. 6 schematically shows a state in which an acoustic wave, generated from the pressure wave generator 1 of the present example, spreads. As shown in FIG. 6, in accordance with the pressure wave generator 1 of the present example, since the wave face of an acoustic wave generated by the heating element 4 is allowed to propagate virtually in parallel with the heating element 4, it is possible to obtain an acoustic wave having a single directivity in the normal direction to the surface of the heating element 4.

Moreover, in accordance with the pressure wave generator 1 of the present example, since the temperature distribution of the heating element 4 that generates heat is made uniform, the life of the heating element 4 can be prolonged. Furthermore, since a large voltage can be applied to the heating element 4, it is possible to increase the maximum sound pressure of the acoustic wave to be outputted. In accordance with the pressure wave generator 1 of the present example, since the temperature distribution of the heating element 4 that generates heat is made uniform, it is possible to obtain an acoustic wave having a single directivity.

Here, the structure of the pressure wave generator 1 explained in the above-mentioned embodiment is just an example, and the structure may be changed and modified on demand. For example, not limited to the structure shown in FIG. 1, the heating element 4 can be designed into various shapes, patterns and sizes. For example, a plurality of heat generating bodies 4 may be formed on the same substrate. Moreover, in the above-mentioned embodiment, a pressure wave to be generated by the pressure wave generator 1 is defined as "acoustic wave"; however, the present invention may of course be applied to a device that generates "ultrasonic wave" as its pressure wave.

As described above, in accordance with the pressure wave generator of the present invention, since the temperature distribution of the conductor layer that generates heat is made uniform, the life of the conductor layer can be prolonged. Moreover, when the temperature distribution of the conductor layer that generates heat becomes uniform, a large voltage (large current) can be applied to the heating element, so that it becomes possible to increase the output sound pressure of the pressure wave.

This application is based upon Japan Patent Application No. 2006-355625, filed Dec. 28, 2006. The specification, claims and the drawings of Japan Patent Application No. 2006-355625 are hereby entirely incorporated in the present specification by reference.

INDUSTRIAL APPLICABILITY

The pressure wave generator and temperature controlling method of the present invention are effectively utilized for generating a compression wave (pressure wave) of air, such as an acoustic wave and an ultrasonic wave.

The invention claimed is:

1. A pressure wave generator comprising:

a thermally conductive substrate;

a heat insulating layer formed on a main surface of the substrate;

an electrical insulating layer formed on the heat insulating layer; and a conductor layer formed on the electrical insulating layer to generate heat when a current containing an alternating component is applied thereto.

2. The pressure wave generator according to claim 1, wherein the heat insulating layer comprises a nanocrystalline silicon.

3. The pressure wave generator according to claim 1, wherein the electrical insulating layer is formed containing at least one of silicon nitride ($Si_3N_4$), silicon dioxide ($SiO_2$), aluminum oxide ($Al_2O_3$), magnesium oxide (MgO), diamond crystalline carbon (C), aluminum nitride (AlN), and silicon carbide (SiC).

4. The pressure wave generator according to claim 1, wherein the conductor layer is formed containing gold (Au) or tungsten (W).

5. The pressure wave generator according to claim 1, wherein a thickness of the heat insulating layer is substantially equal to a thermal diffusion length relative to a frequency of a pressure wave, the thermal diffusion length being determined by a heat conductivity and a heat capacity per unit volume of the heat insulating layer, and wherein a thickness of the electrical insulating layer is thinner than the thermal diffusion length not to absorb heat in a thickness direction of the electrical insulating layer.

6. The pressure wave generator according to claim 5, wherein the heat insulating layer comprises a nanocrystalline silicon, the thickness of the heat insulating layer being in a range from 5 μm to 200 μm, the thickness of the electrical insulating layer being in a range from 50 nm to 2000 nm.

7. The pressure wave generator according to claim 1, wherein the electrical insulating layer is in contact with the conductor layer.

8. The pressure wave generator according to claim 7, wherein the electrical insulating layer is in contact with the heat insulating layer.

9. The pressure wave generator according to claim 1, wherein the electrical insulating layer is arranged to conduct heat generated by the conductor layer along the main surface of the substrate.

10. The pressure wave generator according to claim 1, wherein the conductor layer is disposed within an outline of the heat insulating layer when viewed from a first direction perpendicular to the main surface of the substrate.

11. The pressure wave generator according to claim 10, wherein the heat insulating layer is disposed within an outline of the electrical insulating layer when viewed from the first direction.

12. The pressure wave generator according to claim 1, wherein the conductor layer has a winding shape with a predetermined interval when viewed from a first direction perpendicular to the main surface of the substrate.

13. A method for controlling a temperature of a pressure wave generator which comprises, a thermally conductive substrate;

a heat insulating layer formed on a main surface of the substrate;

an electrical insulating layer formed on the heat insulating layer; and a conductor layer formed on the electrical insulating layer to generate heat when a current containing an alternating component is applied thereto, the method comprising:

forming the electrical insulating layer on the heat insulating layer to control a temperature of the conductor layer.

* * * * *